US006968834B1

(12) United States Patent
Gibbs

(10) Patent No.: US 6,968,834 B1
(45) Date of Patent: Nov. 29, 2005

(54) BOW PRESS

(75) Inventor: Steve Gibbs, Holton, IN (US)

(73) Assignee: C. S. Gibbs Corporation, Versailles, IN (US)

( * ) Notice: Subject to any disclaimer, the term of this patent is extended or adjusted under 35 U.S.C. 154(b) by 0 days.

(21) Appl. No.: 10/939,147

(22) Filed: Sep. 10, 2004

(51) Int. Cl.[7] ..... F41B 5/14
(52) U.S. Cl. ..... 124/1; 124/80
(58) Field of Search ..... 124/1, 80, 86

(56) References Cited

U.S. PATENT DOCUMENTS 5,022,377 A * 6/1991 Stevens ..... 124/23.1
5,222,473 A 6/1993 Lint
5,370,103 A * 12/1994 Desselle ..... 124/86
5,433,186 A 7/1995 Corwin
6,386,190 B1 * 5/2002 Kurtz, Jr. ..... 124/1

* cited by examiner

*Primary Examiner*—John A. Ricci
(74) *Attorney, Agent, or Firm*—Leydig, Voit & Mayer, LTD

(57) ABSTRACT

A bow press for deflecting the limbs of an archery bow includes an adjustment apparatus allowing infinite adjustment of supports for the handle and limbs of the bow, over a range of adjustments. The adjustment apparatus also automatically maintains symmetry between components of the bow press to facilitate adjustment of the press to fit bows of differing dimensions. Inside surface supports are fixed relative to pivot points of pivot arms of the bow press, so that proper alignment of the pivot points with respect to the inside surface supports will be maintained.

29 Claims, 6 Drawing Sheets

BOW PRESS

FIELD OF THE INVENTION

This invention relates to archery bows, and more particularly to apparatuses, commonly known as bow presses, that are used for installing, replacing, or adjustment of a bow string or components of archery bows.

BACKGROUND OF THE INVENTION

Compound bows are widely used by archers. The popularity of the compound bow is mainly due to the advantage provided in the reduced pull force required at full draw together with the resulting increase in accuracy. The pull on the bow string is high at the beginning of the draw but the archer at this point is able to exert maximum force. As the draw progresses a little beyond mid-point, there is an over-center action on eccentrically mounted pulleys or cams of the compound bow which decreases the draw force needed to maintain the bow string in the drawn position while maximizing the energy stored in the limbs of the bow. Thus, at full draw it is relatively easy to hold the arrow and bow string and much easier to perfect aiming technique and proper release resulting in increased accuracy.

A typical compound bow includes one or more eccentrically mounted pulleys or cams pivotably attached relative the bow limbs and serving to support and control the movement of a bow string. The cam, in turn, is often connected to a tension cable. The stringing or tuning of a twin cam bow, with its eccentrically mounted pulleys, tension cable and bow string is very critical in order to achieve a proper balance or synchronization of the eccentrically mounted pulleys or cams. The complexity of the stringing and the sensitivity to proper tuning of the bow, makes it undesirable to unstring the bow when it is not in use. It is also a major project, and in some cases impossible, to string and tune such a bow without the aid of an apparatus commonly known as a bow press.

Because a compound bow cannot be conveniently unstrung and restrung, they are virtually always left in a strung condition. However periodic retuning of compound bows is often required to maintain desired performance levels, and to change, replace or repair components of the compound bow, such as the bow string, string sights, dampers, the tension cable, the cams and other components.

Through the years a number of bow presses have been developed for facilitating stringing, tuning, and maintenance of compound bows. In general, these presses have included a stationary base having a pair of spaced apart inside surface supports, in the form of pegs or rollers, for contacting the inside of the bow, and a pair of limb supports, in the form of pegs or rollers, attached to a movable mechanism for applying a bending force the limbs of the bow. Several problems have been noted with regard to prior bow presses, however.

Prior bow presses can damage the bow, particularly when operated by inexperienced personnel. It is very important that the inside surface support and the limb supports of the bow press be precisely positioned in such a manner that the bow is properly loaded into the press in such a manner that the limbs are bent in a way that will not overstress or otherwise damage the bow. Because compound bows vary dimensionally, from one model or manufacturer to another, it is necessary that the inside surface support and the limb supports on the bow press be adjustable. In the past, it has been customary to provide incremental holes in the bow press so that the position of the inside surface support and the limb supports, or other components of the bow press, could be moved to achieve a best fit with regard to a given bow. The incremental nature of this adjustment approach often results in a fit of the bow press to the bow which is not quite ideal, and can result in damage to the bow. This is especially problematic where personnel operating the bow press lack experience and knowledge.

It is also generally necessary that the bow press be adjusted in a manner that results in a symmetrical positioning of the inside surface supports and the limb supports with respect to the center of the bow handle. Prior bow presses do not provide a convenient means of achieving this symmetry.

Prior bow presses are also not easy to adjust, in that the incrementally movable components are typically bolted to the bow press, thereby requiring the use of wrenches or other tools for making the necessary adjustments.

The limbs of the bow can also be damaged, even when the bow press is properly adjusted, by prior bow presses which use limb supports that must slide or roll along the limb as it is bent in the bow press. Such rolling or sliding supports can cause marring and other physical damage to the limbs.

In some prior bow presses, it is also possible, under some conditions, for the limb supports to be moved to a position along the limbs where the bow will become locked into the bow press. This typically results in significant damage to the bow, and can create a potentially hazardous condition for personnel operating the bow press, as they attempt to remove the bow from the press. In such situations, it may even be necessary to partly disassemble the bow press to get the bow out of the press. The bow limbs will have considerable energy stored in them, which could cause them to spring outward dangerously when parts of bow press are removed to release the bow from the press.

It is desirable, therefore, to provide an improved bow press apparatus and method which overcomes one or more of the problems described above, or other problems and shortcomings of prior bow presses.

BRIEF SUMMARY OF THE INVENTION

The invention provides an improved apparatus and method for deflecting the limbs of an archery bow to allow installation, replacement, or adjustment of a bow string or components of the bow, where the bow includes a bow handle and two limbs extending in opposite directions from the bow handle, with each limb including provisions at a distal end thereof for attaching the string.

In one form of the invention, a bow press includes a base, first and second pivot arms, and an adjustment apparatus operatively connecting the first and second pivot arms to the base. The base defines a longitudinal axis of the base, and is adapted for retaining the bow handle. The first pivot arm is adapted for applying a bending force against one of the limbs of the bow, and the second pivot arm is adapted for applying a bending force against the other limb of the bow. The first and second pivot arms are spaced from one another along the longitudinal axis of the base, with each of the first and second pivot arms having a pivoted end and a distal end thereof. The pivoted end of each pivot arm is operatively attached by the adjustment apparatus, to the base, for pivoting motion about a respective pivot axis of that pivot arm, in a manner that constrains the distal end of that pivot arm to circumscribe an arc extending generally parallel to a plane including the longitudinal axis of the base. The first and second pivot arms are also operatively and symmetrically attached to the base on opposite sides of a second axis extending orthogonally through the longitudinal axis of the base within the plane including the longitudinal axis of the base. The adjustment apparatus provides simultaneous selective movement of the first and second pivot arms along the longitudinal axis, toward or away from the second axis, while continually maintaining the symmetrical relationship of the pivoted ends of the first and second pivot arms to the second axis.

In another form of the invention, a bow press includes a base, first and second inside surface supports, a first and a second pivot arm, a first and a second limb support, and an adjustment apparatus. The base defines a longitudinal axis of the base. The first and second inside surface supports are adapted for retaining the bow handle during use of the bow press. The inside surface supports are operatively attached to the base in a manner providing infinitely adjustable movement relative to one another along the longitudinal axis of the base over a predetermined range of inside surface support positions. The first pivot arm is adapted for applying a bending force against a first limb of the bow, and the second pivot arm is adapted for applying a bending force against the second limb of the bow. The adjustment apparatus operatively connects the first and second pivot arms to the base.

The first limb support may be slidingly attached to the first pivot arm and adapted for contacting an outside surface of the first limb at a point along the first limb adjacent the distal end of the first limb. The second limb support may be slidingly attached to the second pivot arm and adapted for contacting an outside surface of the second limb at a point along the second limb adjacent the distal end of the second limb. The first and second limb supports may be operatively attached to the first and second pivot arms respectively for infinitely adjustable movement along the first or second pivot arm respectively, within a range of adjustment of the first and second limb supports, to thereby allow the first and second limb supports to be positioned respectively adjacent the distal ends of the first and second limbs of the bow.

In another form of the invention, a bow press includes a base, a pivot arm operatively connected to the base by a pivot arm bracket, and an inside surface support. The base defines a longitudinal axis of the base, and a second axis extending through the base orthogonally through the longitudinal axis. The longitudinal axis of the base and the second axis define a plane including both the longitudinal axis of the base and the second axis. The pivot arm is adapted for applying a bending force against one of the limbs of a bow. The pivot arm bracket operatively connects the pivot arm to the base, and defines a pivot axis. The inside surface support is adapted for contacting an inside surface of the bow at a first point along the bow. The pivot arm has a pivoted end and a distal end thereof, with the pivoted end being pivotably attached to the pivot arm bracket for pivoting motion of the pivot arm about a pivot axis in a manner that constrains the distal end the pivot arm to circumscribe an arc extending generally parallel to the plane including the longitudinal axis of the base. The inside surface support is attached to the pivot arm bracket at a point inboard of the first pivot axis, with respect to the second axis, and extends generally transversely outward from the pivot arm bracket, with respect to the plane containing both the first longitudinal axis and the second axis, with the spacing between the inside surface support and the pivot axis being fixed at a predetermined distance. The inside surface support may also be disposed in close proximity to the pivot point at a location that is farther away from the longitudinal axis than the pivot point.

Other aspects, objectives and advantages of the invention will be apparent from the following detailed description and the accompanying drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF EXEMPLARY EMBODIMENTS

Figure 1:
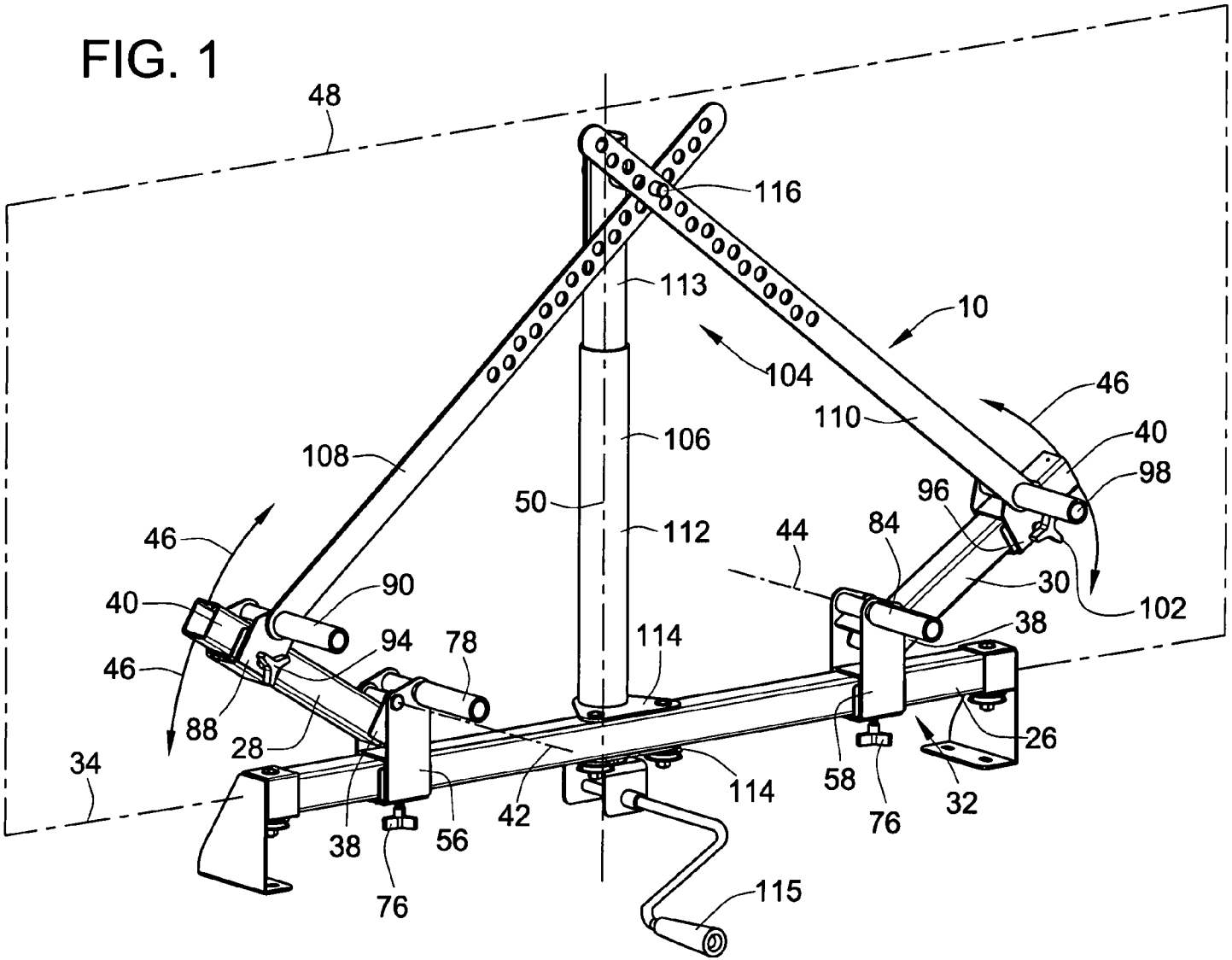
FIG. 1 is a perspective view of an exemplary embodiment of a bow press, according to the invention.
Figure 2:
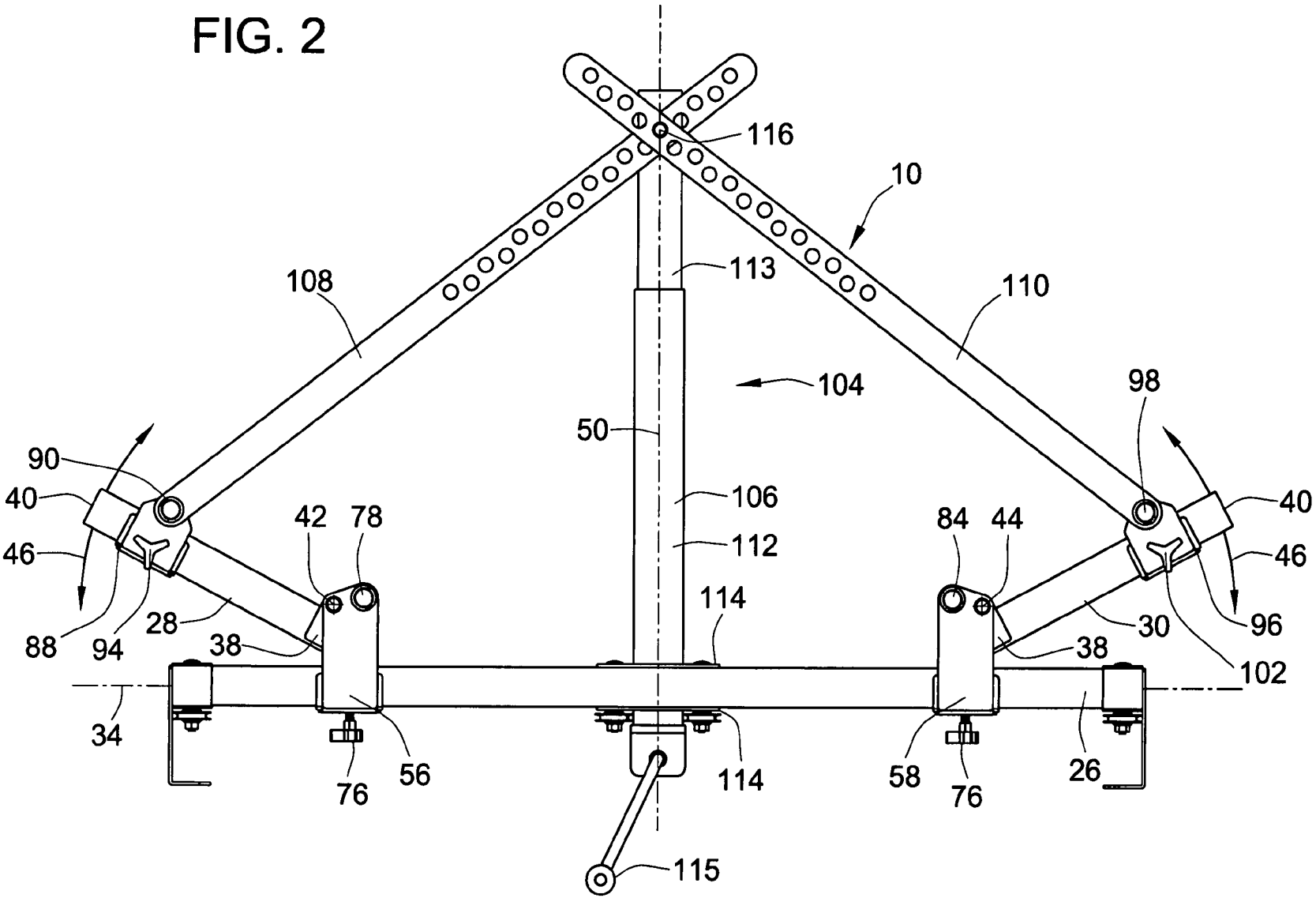
FIG. 2 is an orthographic elevation view of the bow press of FIG. 1.
Figure 3:
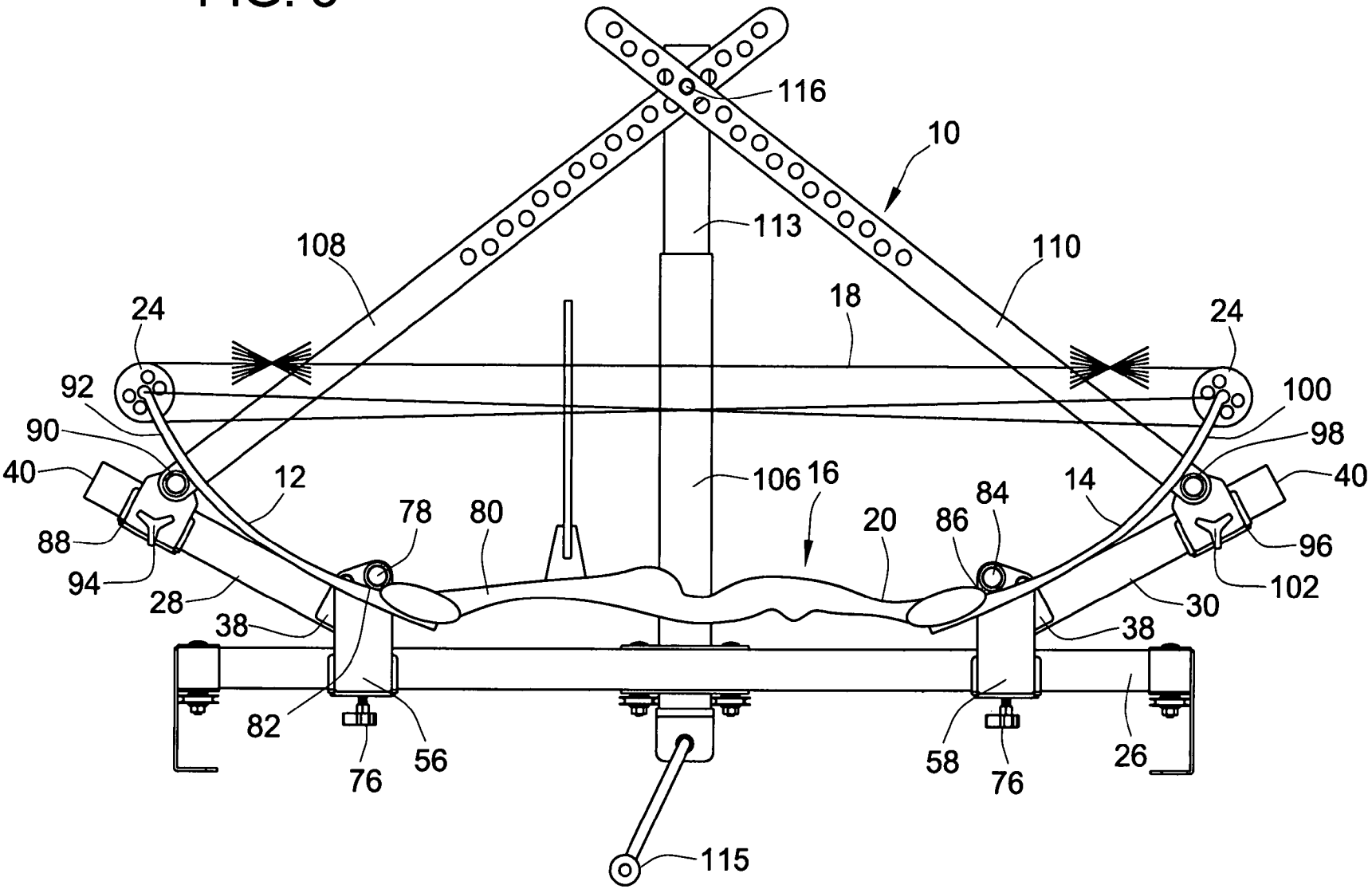
FIG. 3 is an orthographic elevation view of the bow press of FIGS. 1 and 2, showing a bow installed in the bow press, prior to applying bending force to the bow.
Figure 4:
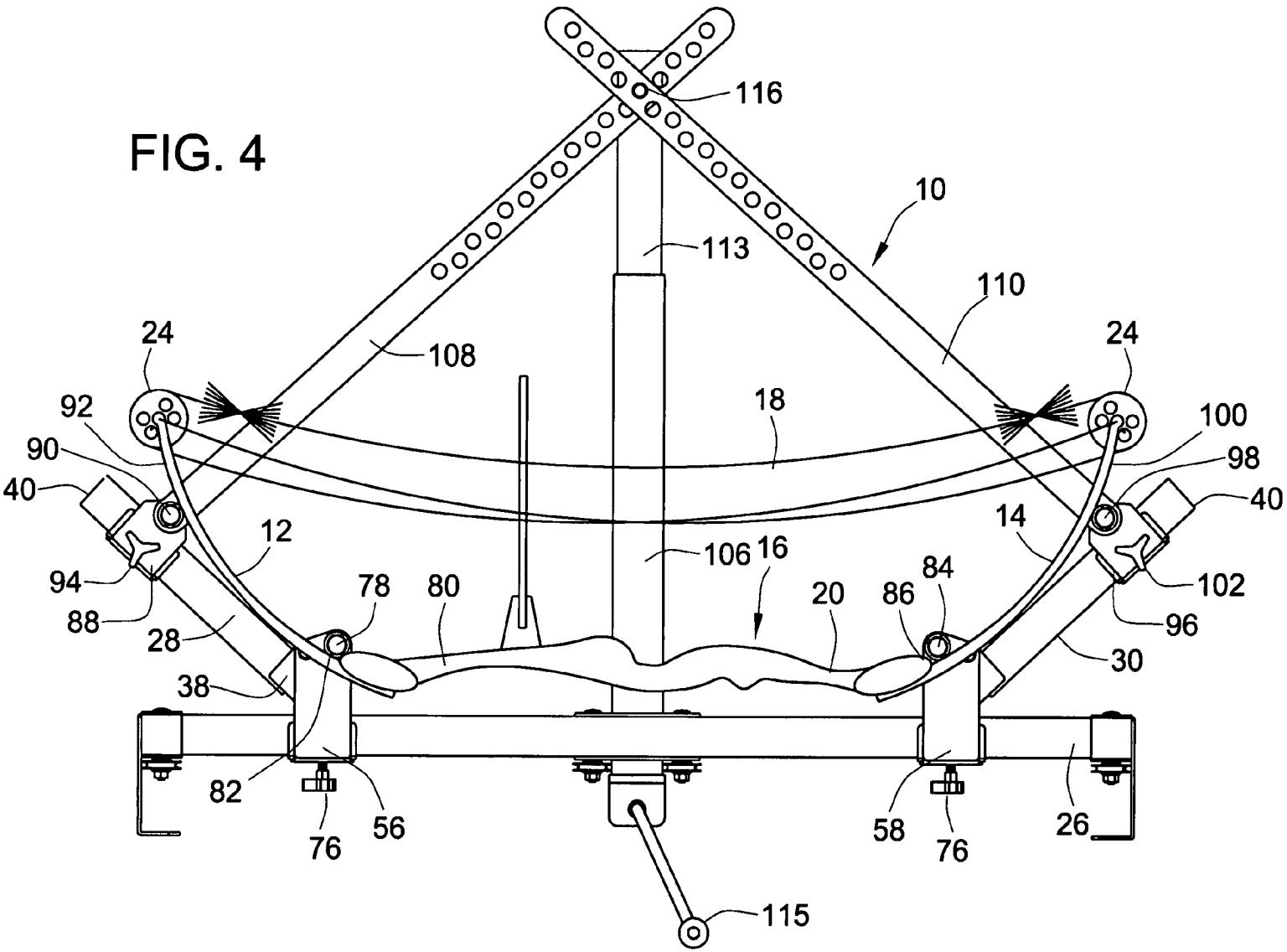
FIG. 4 is an orthographic elevation view of the bow press of FIGS. 1–3, showing a bow installed in the bow press and being bent by applying bending force to the bow through use of the bow press.

FIGS. 1–4 show an exemplary embodiment of a bow press 10, according to the invention, for deflecting the limbs 12, 14 of an archery bow 16, as shown in FIGS. 3 and 4, to allow installation, replacement, or adjustment of a bow string 18 or components of the bow 16. The bow 16 includes a bow handle 20 and the two limbs 12, 14 extending in opposite directions from the bow handle 20. The bow 16 also includes provisions, in the form of pulleys, etc., illustrated generally as reference numeral 24, at the distal end of the limbs 12, 14 for attaching the bow string 18.

As shown in FIGS. 1 and 2, the exemplary embodiment of the bow press 16 includes a base 26, first and second pivot arms 28, 30, and an adjustment apparatus 32 (best seen in FIG. 5) operatively connecting the first and second pivot arms 28, 30 to the base 26. The base 26 defines a longitudinal axis 34 of the base and is adapted, in the manner described in greater detail below, for retaining the bow handle 20. The first pivot arm 28 is adapted, as described below, for applying a bending force against one of the limbs (limb 12 as shown in FIGS. 3 and 4) of the bow 16, and the second pivot arm 30 is adapted, as described below, for applying a bending force against the other limb (limb 14 as shown in FIGS. 3 and 4) of the bow 16.

The first and second pivot arms 28, 30 are spaced from one another along the longitudinal axis 34 of the base 26, with each of the first and second pivot arms 28, 30 having a pivoted end 38 and a distal end 40 thereof, as shown in FIGS. 1 and 2. The pivoted end 38 of each pivot arm 28, 30 is operatively attached by the adjustment apparatus 32, to the base 26, for pivoting motion about a respective pivot axis 40, 42 of that pivot arm 28, 30, in a manner that constrains the distal end 40 of that pivot arm 28, 30 to circumscribe an arc 46 extending generally parallel to a plane 48 (as illustrated in FIG. 1) including the longitudinal axis of the base 26.

The first and second pivot arms 28, 30 are also operatively and symmetrically attached to the base 26 on opposite sides of a second axis 50 extending orthogonally through the longitudinal axis 34 of the base 26, within the plane 48 including the longitudinal axis 34 of the base 26. The adjustment apparatus 32 provides simultaneous selective movement, in the manner described below, of the first and second pivot arms 28, 30 along the longitudinal axis 34, toward or away from the second axis 50, while continually maintaining the symmetrical relationship of the pivoted ends 38 of the first and second pivot arms 28, 30 to the second axis 50.

The bow press 10 further includes a first pivot arm bracket 56 for operatively connecting the pivoted end 38 of the first pivot arm 28 to the base 26, and a second pivot arm bracket 58 for operatively connecting the pivoted end 38 of the second pivot arm 30 to the base 26. As will be appreciated from the drawings, the pivot arm brackets 26, 58 are slidingly attached to the base 16 in such a manner that the first and second pivot arms 28, 30 are operatively connected to the base 26 and one another for sliding movement along the longitudinal axis 34 of the base 16.

Figure 5:
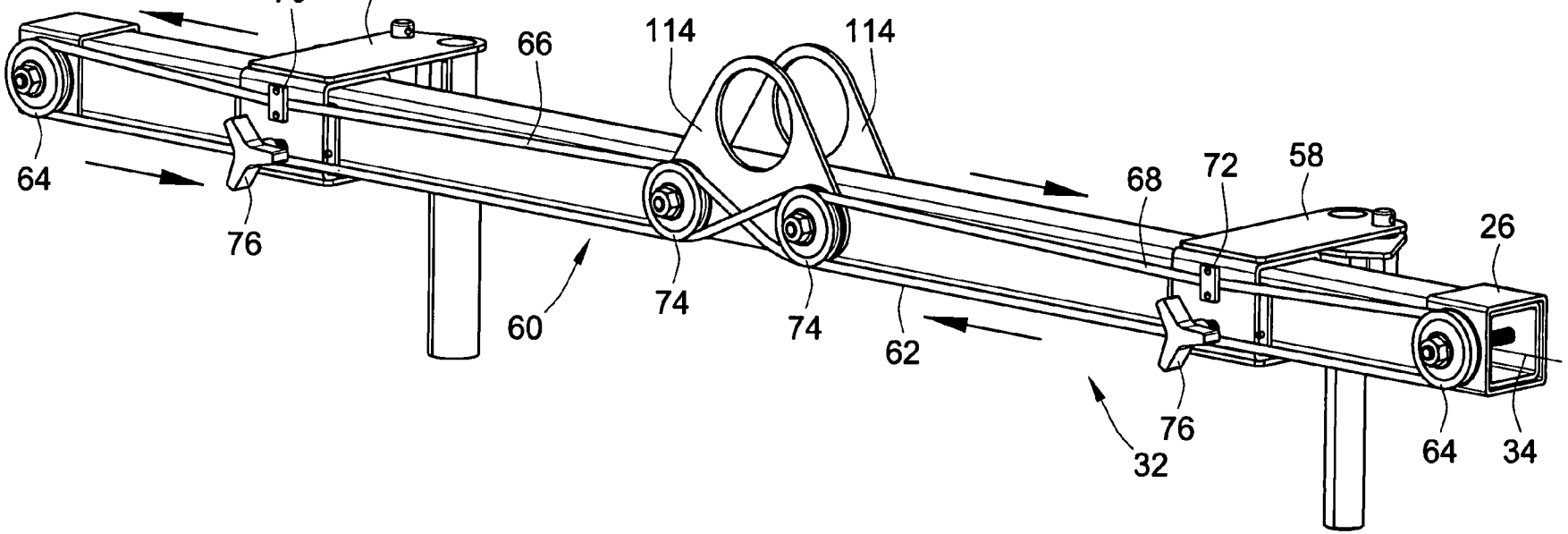
FIG. 5 is a partial bottom perspective view of the bow press of FIGS. 1–3, with certain elements removed for clarity of illustration, showing an adjustment apparatus according to the invention.

The adjustment apparatus 32 includes a bracket positioning apparatus, generally indicated at reference numeral 60 in FIG. 5, operatively connected to the first and second pivot arm brackets 56, 58 in such a manner that when one of the first and second pivot arm brackets 56, 58 is moved a distance along the longitudinal axis 34 of the base 26, the bracket positioning apparatus 60 moves the other of the first and second pivot arm brackets 56, 58 in the opposite direction along the longitudinal axis 34 of the base 26 a distance equal to the distance that first pivot arm bracket (56 or 58) was moved along the longitudinal axis 34 of the base 26.

As best seen in FIG. 5, the bracket positioning apparatus 60, of the exemplary embodiment of the bow press 10, includes an endless belt 62 operatively attached by a pair of end pulleys 64 to the base 26 and disposed to form a continuous loop having a first section 66 and a second section 68 extending generally parallel to the longitudinal axis 34 of the base 26. The first section 66 of the belt 62 is fixedly attached by a clamp 70 to the first pivot arm bracket 56, and the second section 68 of the belt 62 is fixedly attached by a clamp 72 to the second pivot arm bracket 58. The bracket positioning apparatus 60 further includes a pair of crossover pulleys 74, operatively attached to the base 26, for routing the endless belt 62 in the manner shown in FIG. 5, so that when one of the pivot arm brackets (56 or 58) is moved a distance in a one direction along the longitudinal axis 34 of the base 26, the belt 62 will move the other pivot arm bracket (56 or 58) an equal distance in the opposite direction along the longitudinal axis 34 of the base 26. By virtue of this arrangement, the first and second pivot arms 28, 30 are operatively connected to allow only simultaneous sliding movement of the first and second pivot arms 56, 58 in opposite directions along the longitudinal axis 34 of the base 26.

The bracket positioning apparatus 60 of the exemplary embodiment of the bow press 10 also includes a pair of locking devices, in the form of a pivot arm bracket hand screw 76 operatively attached to each of the first and second pivot arm brackets 56, 58, for selectively securing the first and second pivot arm brackets 56, 58 to the base 26, to thereby restrain the first and second pivot brackets 56, 58 against movement with respect to the base 26.

It will be recognized, however, that in other embodiments of the invention, different types of apparatuses may be utilized for performing the functions provided by the endless belt 62, pulleys 64 and 74, and the hand screws 76 of the exemplary embodiment of the bracket positioning apparatus 60 described above. For example, FIG. 6 shows an alternate embodiment of an adjustment apparatus according to the invention, in which the cross-over pulleys 74 are eliminated, through use of a different arrangement for attaching the endless belt 62 to the first and second pivot arm brackets 56, 58.

Figure 6:
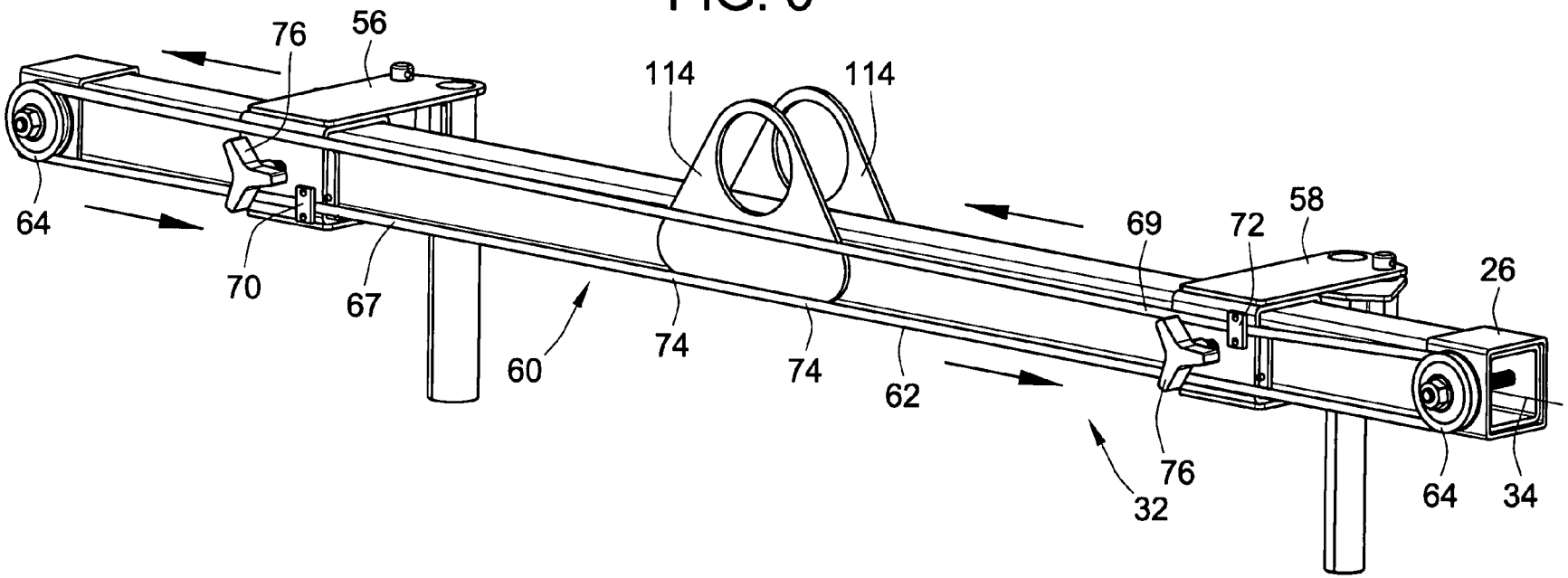
FIG. 6 is a partial bottom perspective view of the bow press of FIGS. 1–3, with certain elements removed for clarity of illustration, showing an alternate embodiment of an adjustment apparatus according to the invention.

In the alternate embodiment of the bracket positioning apparatus 60, shown in FIG. 6, the endless belt 62 is operatively attached by a pair of end pulleys 64 to the base 26 and disposed to form a continuous loop having a first section 67 and a second section 69 extending generally parallel to the longitudinal axis 34 of the base 26. The first section 67 of the belt 62 is fixedly attached by a clamp 70 to the first pivot arm bracket 56, and the second section 69 of the belt 62 is fixedly attached by a clamp 72 to the second pivot arm bracket 58. With this arrangement, the endless belt forms an oblong loop around the end pulleys 64, so that when one of the pivot arm brackets (56 or 58) is moved a distance in a one direction along the longitudinal axis 34 of the base 26, the belt 62 will move the other pivot arm bracket (56 or 58) an equal distance in the opposite direction along the longitudinal axis 34 of the base 26. By virtue of this arrangement, the first and second pivot arms 28, 30 are operatively connected to allow only simultaneous sliding movement of the first and second pivot arms 56, 58 in opposite directions along the longitudinal axis 34 of the base 26, without resorting to the cross-over pulleys 74 of the embodiment shown in FIGS. 1–5.

The exemplary embodiment of the bow press 10 includes a first inside surface support 78, adapted for contacting an inside surface 80 of the bow handle 20 and/or the first limb 12 at a first point 82 along the bow 16, that is closely adjacent to the intersection of the bow handle 20 and the first limb 12. Whether the first inside surface support 78 contacts the inside surfaces of both the bow handle 20 and the first limb 12, at the first contact point 82, as shown in FIGS. 3 and 4, or the inside surface of only the handle 20, or only the inside surface of first limb 12, will depend upon the configuration of the bow 16. In all cases, however, the invention allows the first inside surface support 78 to be placed as close as possible to the intersection of the first limb 12 and the handle 20, so that the bow 16 can bend in the bow press 10, about the intersection of the first limb 12 and the handle 20, in a manner that closely approximates the manner in which it is bent during actual use.

The first inside surface support 78 is attached to the first pivot arm bracket 56 at a point located inboard of the first pivot axis 42, with respect to the second axis 50, at a fixed distance from the first pivot axis 42, and extends generally transversely outward from the first pivot arm bracket 56 in a first direction (out of the page as depicted in FIGS. 1 and 2) from the plane 48 containing both the first longitudinal axis 34 and the second axis 50. This closely adjacent but slightly inboard positioning of the first handle support 78, with respect to the pivot axis 42 of the first pivot arm 28, together with having both the first inside surface support 78 and first pivot axis 42 located at a fixed distance from one another on the first pivot arm support 56, provides an advantageous arrangement for properly supporting the inside surface 80 of the bow 20 in a manner that allows the first limb 12 to flex, during use of the bow press 10, in a manner that is very similar to the way the first limb 12 flexes when the bow 16 is in normal use.

In similar fashion, the exemplary embodiment of the bow press 10 includes a second inside surface support 84, adapted for contacting the inside surface 80 of the bow handle 20 and/or the second limb 14 at a second point 86 along the bow 16, that is closely adjacent to the intersection of the bow handle 20 and the second limb 14. Whether the first second inside surface support 84 contacts the inside surfaces of both the bow handle 20 and the second limb 14, at the second contact point 86, as shown in FIGS. 3 and 4, or the inside surface of only the handle 20, or only the inside surface of second limb 14, will depend upon the configuration of the bow 16. In all cases, however, the invention allows the second inside surface support 84 to be placed as close as possible to the intersection of the second limb 14 and the handle 20, so that the bow 16 can bend in the bow press 10, about the intersection of the second limb 14 and the handle 20, in a manner that closely approximates the manner in which it is bent during actual use.

The second inside surface support 84 is attached to the second pivot arm bracket 58 at a point located inboard of the second pivot axis 44, with respect to the second axis 50, at a fixed distance from the second pivot axis 44, and extends generally transversely outward from the second pivot arm bracket 58 in a first direction (out of the page as depicted in FIGS. 1 and 2) from the plane 48 containing both the first longitudinal axis 34 and the second axis 50. This closely adjacent but slightly inboard positioning of the second handle support 84, with respect to the pivot axis 44 of the second pivot arm 30, together with having both the second inside surface support 84 and second pivot axis 44 located at a fixed distance from one another on the second pivot arm support 58, provides an advantageous arrangement for properly supporting the inside surface 80 of the bow 20 in a manner that allows the second limb 14 to flex, during use of the bow press 10, in a manner that is very similar to the way the second limb 14 flexes when the bow 16 is in normal use.

The exemplary embodiment of the bow press 10 further includes a first limb support bracket 88 slidingly attached to the first pivot arm 28, and having a first limb support 90 extending generally transversely outward from the first limb support bracket 88 in the first direction (out of the page as shown in FIGS. 1 and 2) from the plane 48 containing both the first longitudinal axis 34 and the second axis 50. The first inside surface support 88 is adapted for contacting an outside surface 92 of the first limb 12 at a point along the first limb adjacent the distal end 40 of the first limb 12. The first limb support bracket 88 includes a first limb support locking device, in the form of a hand screw 94 for locking the first limb support bracket 88 against movement relative to the first pivot arm 28 at a selected location with respect to the first pivot axis 42.

In similar fashion, a second limb support bracket 96 is slidingly attached to the second pivot arm 30 and includes a second limb support 98 extending generally transversely outward from the second limb support bracket 96 in the first direction (out of the page as shown in FIGS. 1 and 2) from the plane 48 containing both the first longitudinal axis 34 and the second axis 50, with the second inside surface support 96 being adapted for contacting an outside surface 100 of the second limb 14 at a point along the second limb 14 adjacent the distal end 40 of the second limb 14. The second limb support bracket 96 includes a second limb support locking device, in the form of a hand screw 102 for locking the second limb support bracket 96 against movement relative to the second pivot arm 30, at a selected location with respect to the second pivot axis 44.

The exemplary embodiment of the bow press 10 further includes an actuation apparatus, generally indicated at 104 in FIGS. 1 and 2, operatively connecting the first and second pivot arms 28, 30, for selectively pivoting the first and second pivot arms 28, 30 about their respective first and second pivot axes 42, 44, in a manner providing symmetrical movement of the distal ends 40 of the first and second pivot arms 28, 30 with respect to the second axis 50, in a direction away from or toward the base 26. Specifically, the actuation apparatus 104 of the exemplary embodiment includes a screw jack 106, a first link 108, and a second link 110. The screw jack 106 has a stationary base section 112, thereof, attached to the base 26 of the bow press 10 by a pair of jack mounting brackets 114, as shown in FIGS. 1, 2, and 5, and an extensible section 113 telescoping into the base section 110 of the screw jack 106. The screw jack 106 is attached to the base 26 of the bow press 10 in such a manner that as a screw crank 115 of the screw jack 106 is turned, the extensible section 113 of the screw jack 106 extends and retracts along a path that is generally parallel to the second axis 50.

The first and second links 108, 110 each have a first end thereof pivotably attached respectively to the first and second pivot arms 28, 30. In the exemplary embodiment, the links 108, 110 are attached to the first and second limb support brackets 88, 96 to pivot about the centerlines of the first and second limb supports 90, 98, but in other embodiments of the invention, other pivoting connection arrangements may be used between the links 108, 110 and the pivot arms 28, 30 The first and second links 108, 110 intersect and are pivotably joined to one another at the intersection by a common connection, in the form of a pin 116 extending outward from the extensible section 113 of the screw jack 106.

By virtue of the mounting arrangement of the screw jack 106, and other components of the exemplary embodiment of the bow press 10, as described above, the pin 116 intersects and moves generally along the second axis 50 such that the common connection lies generally along the second axis 50, and the first and second links 108, 110 have equal lengths between their respective first ends, at the first and second limb supports 90, 98, and the common connection provided by the pin 116. The screw jack 106 functions as an extensible force applying element operatively disposed between the base 26 and the common connection at the pin 116, for applying bending force to the limbs 12, 14 of a bow 16 mounted in the bow press 10.

Operation of the exemplary embodiment of the bow press 10 is illustrated in FIGS. 3 and 4. The bow 16, in either a strung or an unstrung condition, is placed into the bow press 10, generally in the orientation shown, and the position of the inside surface supports 78, 84 and limb supports 90, 98 are adjusted to fit the bow 16. If necessary, the crank 115 of the screw jack 106 is used to retract the extensible section 113 of the screw jack 106 to an initial position where the bow 16 can be inserted into the press 10 with the inside surface supports 78, 84 generally on the inside 80 of the bow 16 closely adjacent the intersections of the first and second limbs 12, 14 with the handle 20, and the first and second limb supports 90, 98 on the outside surfaces 92, 100 of the first and second limbs 12, 14 respectively.

The intersection point between the first and second links 108, 100 may also be adjusted, if necessary, by placing a different hole in the links 108, 110 over the pin 116, to allow entry of the bow 16 into the bow press 10. Adjacent holes in the links 108, 110 are laterally offset from one another to aid in visually connecting the links 108, 110 to the pin 116 in such a manner that the links 108, 110 have equal lengths between their respective first ends, at the first and second limb supports 90, 98, and the common connection provided by the pin 116.

The hand screws 76 on the first and second pivot arm brackets 56, 58 are loosened, if necessary, to allow the first and second pivot arm brackets 56, 58 to be moved along the longitudinal axis 34 of the base 26, for placing the first and second inside surface supports 78, 84 in a proper position along the inside 80 of the bow 16 to contact the inside surface 80 of the bow 16 at points 82, 86 closely adjacent to where the first and second limbs 12, 14, respectively, join the handle 20.

By virtue of the construction of the exemplary embodiment of the bow press 10, as described above, the position of the first and second pivot arm brackets 56, 58 along the longitudinal axis 34 is infinitely adjustable, and not limited to set increments defined by spaced bolt holes, as was the case in prior bow presses, to thereby allow for very precise and proper positioning of the location of the inside surface supports 78, 84 to match the bow 16. Also, by virtue of the unique function of the adjustment apparatus 32 of the exemplary embodiment, as either of the first or second pivot arm brackets 56, 58 is moved along the longitudinal axis 34, the other pivot arm bracket (56 or 58) moves an equal distance in the opposite direction along the longitudinal axis 34, so that the first and second handle supports 78, 84, and the pivot axes 42, 44 are always maintained at symmetrical locations with respect to the second axis 50, regardless of where either of the pivot arm brackets 56, 58 is positioned along the longitudinal axis 34.

Having the adjustment apparatus 32 available to facilitate movement and maintaining symmetrical location of the pivot arm brackets 56, 58 provides a considerable advantage in that the bow 16 can be held in position by one hand of a person operating the bow press, while the other hand is being used to move one or the other of the pivot arm brackets 56, 58 into position along the longitudinal axis 34.

Once the inside surface supports 78, 84 are properly positioned, the hand screws 76 on the pivot arm brackets 56, 58 are tightened to lock the pivot arm brackets 56, 58 in place along the longitudinal axis 34.

The positions of the first and second limb supports 90, 98 are then adjusted, by loosening the hand screws 94, 102, and sliding the limb support brackets 88, 96 along the first and second pivot arms 28, 30, to position the limb supports 90, 98 close to the string attachment provisions 24 at the distal ends of the limbs 12, 14, and the hand screws 94, 102 are tightened to lock the limb support brackets 88, 96 in the desired locations on the first and second pivot arms 28, 30.

If necessary, the common connection point of the links 108, 110 with the pin 116 can then be adjusted to provide sufficient stroke of the extensible section 113 of the screw jack 106 for bending the bow 16 sufficiently for performing whatever repair or adjustment is required. The crank 115 is then turned to extend the jack 106 for bending the bow 16, in the manner shown in FIG. 4, and the required repair or adjustment is performed on the bow 16, while the bow 16 is being held in a bent state by the bow press 10. When the repair or adjustment is completed, the crank 115 is turned in the opposite direction to retract the jack 106 to a point that the bow 16 can be removed from the bow press 10.

Those having skill in the art will recognize that a bow press, in accordance with the invention, provides significant advantages that greatly facilitate repair and adjustment of compound bows. In particular, it will be noted that the pivoting arm construction and other features of the invention provide a bow press that is easier to operate and more fool-proof than prior bow presses. A bow press, according to the invention, when properly adjusted and operated will virtually eliminate the problem experienced in some prior bow presses of having a bow be improperly bent in such a manner that the bow will lock itself into the bow press and cannot be readily removed, even if bending force is removed. In the present invention, such a locked-in condition is almost impossible to achieve, and in the event that it were to occur through improper operation of the bow press, the pivoting arms and other features of the invention will allow bending pressure to be released from the limbs, so that the bow can be safely removed from the bow press.

Those having skill in the art will also recognize that, although the invention has been described herein with reference to several exemplary embodiments, many other embodiments of the invention are possible. For example, the manually operable screw jack of the exemplary embodiment may be replaced by other types of extensible force generating elements.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventor for carrying out the invention. Variations of those preferred embodiments may become apparent to those of ordinary skill in the art upon reading the foregoing description. The inventor expects skilled artisans to employ such variations as appropriate, and the inventor intends for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A bow press, for deflecting the limbs of an archery bow to allow installation, replacement, or adjustment of a bow string or components of the bow, where the bow includes a bow handle and two limbs extending in opposite directions from the bow handle, with each limb including provisions at a distal end thereof for attaching the string, the bow press comprising:

a base defining a longitudinal axis of the base, and adapted for retaining the bow handle;

a first pivot arm for applying a bending force against one of the limbs of the bow;

a second pivot arm for applying a bending force against the other of the limbs of the bow; and an adjustment apparatus operatively connecting the first and second pivot arms to the base;

the first and second pivot arms being spaced from one another along the longitudinal axis of the base, with each of the first and second pivot arms having a pivoted end and a distal end thereof, the pivoted end of each pivot arm being operatively attached by the adjustment apparatus to the base for pivoting motion about a respective pivot axis of that pivot arm in a manner that constrains the distal end of that pivot arm to circumscribe an arc extending generally parallel to a plane including the longitudinal axis of the base;

the first and second pivot arms also being operatively and symmetrically attached to the base on opposite sides of a second axis extending orthogonally through the longitudinal axis of the base within the plane including the longitudinal axis of the base;

the adjustment apparatus providing simultaneous selective movement of the first and second pivot arms along the longitudinal axis, toward or away from the second axis, while continually maintaining the symmetrical relationship of the pivoted ends of the first and second pivot arms to the second axis.

2. The bow press of claim 1, wherein the first and second pivot arms are operatively connected to the base and one another for sliding movement along the longitudinal axis of the base.

3. The bow press of claim 2, wherein the first and second pivot arms are operatively connected to allow only simultaneous sliding movement of the first and second pivot arms in opposite directions along the longitudinal axis of the base.

4. The bow press of claim 3, further comprising, a first pivot arm bracket for operatively connecting the pivoted end of the first pivot arm to the base, and a second pivot arm bracket for operatively connecting the pivoted end of the second pivot arm to the base.

5. The bow press of claim 4, wherein the first and second pivot arm brackets are slidingly attached to the base.

6. The bow press of claim 5, wherein the adjustment apparatus includes a bracket positioning apparatus operatively connected to the first and second pivot arm brackets in such a manner that when one of the first and second pivot arm brackets is moved a distance along the longitudinal axis of the base, the bracket positioning apparatus moves the other of the first and second pivot arm brackets in the opposite direction along the longitudinal axis of the base a distance equal to the distance that one of the first and second pivot arm brackets was moved along the longitudinal axis of the base.

7. The bow press of claim 6, wherein the bracket positioning apparatus includes an endless belt operatively attached to the base and disposed to form a loop having a first section and a second section extending generally parallel to the longitudinal axis of the base, with the first section of the belt being fixedly attached to the first pivot arm bracket, and the second section of the belt being fixedly attached to the second pivot arm bracket, whereby when one of the pivot arm brackets is moved a distance in a one direction along the longitudinal axis of the base, the belt will move the other pivot arm bracket an equal distance in the opposite direction along the longitudinal axis of the base.

8. The bow press of claim 5, further comprising a locking device for selectively securing at least one of the first and second pivot arm brackets to the base, to thereby restrain the first and second pivot brackets against movement with respect to the base.

9. The bow press of claim 5, wherein the first and second pivot arm brackets define the first and second pivot axes respectively.

10. The bow press of claim 9, further comprising:

a first inside surface support attached to the first pivot arm bracket at a point inboard of the first pivot axis, with respect to the second axis, and extending generally transversely outward from the first pivot arm bracket in a first direction from the plane containing both the first longitudinal axis and the second axis, the first inside surface support being adapted for contacting an inside surface of the bow at a first point along the bow; and a second inside surface support attached to the second pivot arm bracket at a point inboard of the second pivot axis, with respect to the second axis, and extending generally transversely outward from the second pivot arm bracket in the first direction from the plane containing both the first longitudinal axis and the second axis, the second inside surface support being adapted for contacting an inside surface of the bow at a second point along the bow.

11. The bow press of claim 10, wherein the spacing between at least one of the inside surface supports and its associated pivot axis is fixed.

12. The bow press of claim 11, wherein the at least one inside surface support is disposed in close proximity to its associated pivot point and at a location that is farther away from the longitudinal axis than its associated pivot point.

13. The bow press of claim 12, further comprising:

a first limb support bracket slidingly attached to the first pivot arm and having a first limb support extending generally transversely outward from the first limb support bracket in the first direction from the plane containing both the first longitudinal axis and the second axis, the first limb support being adapted for contacting an outside surface of the first limb at a point along the first limb adjacent the distal end of the first limb; and a second limb support bracket slidingly attached to the second pivot arm and having a second limb support extending generally transversely outward from the second limb support bracket in the first direction from the plane containing both the first longitudinal axis and the second axis, the second limb support being adapted for contacting an outside surface of the second limb at a point along the second limb adjacent the distal end of the second limb.

14. The bow press of claim 13, further comprising a first limb support locking device for locking the first limb support bracket against movement relative to the first pivot arm at a selected location with respect to the first pivot axis.

15. The bow press of claim 14, further comprising a second limb support locking device for locking the second limb support bracket against movement relative to the second limb support arm at a selected location with respect to the second pivot axis.

16. The bow press of claim 15, further comprising an actuation apparatus, operatively connecting the first and second pivot arms for selectively pivoting the first and second pivot arms about their respective first and second pivot axes, in a manner providing symmetrical movement of the distal ends of the first and second pivot arms with respect to the second axis, in a direction away from or toward the base.

17. The bow press of claim 16, wherein the actuation apparatus includes a screw jack.

18. The bow press of claim 16, wherein the actuation apparatus includes a first link having a first end thereof pivotably attached to the first pivot arm, a second link having a first end thereof pivotably attached to the second pivot arm, with the first and second links intersecting and being pivotably joined to one another at the intersection by a common connection lying generally along the second axis such that the first and second links have equal lengths between the respective first ends thereof and the common connection.

19. The bow press of claim 18, wherein the actuation apparatus further comprises an extensible force applying element operatively disposed between the base and the common connection.

20. The bow press of claim 19, wherein the extensible force applying element includes a screw jack having one end thereof attached to the base and a second end thereof attached to the common connection.

21. A bow press, for deflecting the limbs of an archery bow to allow installation, replacement, or adjustment of a bow string or components of the bow, where the bow includes a bow handle and two limbs extending in opposite directions from the bow handle, with each limb including provisions at a distal end thereof for attaching the string, the bow press comprising:

a base defining a longitudinal axis of the base;

first and second inside surface supports, adapted for retaining the bow, and operatively attached to the base for infinitely adjustable movement relative to one another along the longitudinal axis of the base over a predetermined range of inside surface support positions;

a first pivot arm for applying a bending force against a first limb of the bow;

a second pivot arm for applying a bending force against the second limb of the bow; and an adjustment apparatus operatively connecting the first and second pivot arms to the base.

22. The bow press of claim 21, further comprising:

a first limb support slidingly attached to the first pivot arm and adapted for contacting an outside surface of the first limb at a point along the first limb adjacent the distal end of the first limb; and a second limb support slidingly attached to the second pivot arm and adapted for contacting an outside surface of the second limb at a point along the second limb adjacent the distal end of the second limb;

the first and second limb supports being operatively attached to the first and second pivot arms respectively for infinitely adjustable movement along the first or second pivot arm respectively, within a range of adjustment of the first and second limb supports; to thereby allow the first and second limb supports to be positioned respectively adjacent the distal ends of the first and second limbs of the bow.

23. The bow press of claim 21, further comprising:

an adjustment apparatus operatively connecting the first and second pivot arms to the base;

the first and second pivot arms being spaced from one another along the longitudinal axis of the base, with each of the first and second pivot arms each having a pivoted end and a distal end thereof, the pivoted end of each pivot arm being operatively attached by the adjustment apparatus to the base for pivoting motion about a respective pivot axis of that pivot arm in a manner that constrains the distal end that pivot arm to circumscribe an arc extending generally parallel to a plane including the longitudinal axis of the base;

the first and second pivot arms also being operatively and symmetrically attached to the base on opposite sides of a second axis extending orthogonally through the longitudinal axis of the base within the plane including the longitudinal axis of the base;

the adjustment apparatus providing simultaneous selective movement of the first and second pivot arms along the longitudinal axis, toward or away from the second axis, while continually maintaining the symmetrical relationship of the pivoted ends of the first and second pivot arms to the second axis.

24. The bow press of claim 23, further comprising:

a first limb support slidingly attached to the first pivot arm and adapted for contacting an outside surface of the first limb at a point along the first limb adjacent the distal end of the first limb; and a second limb support slidingly attached to the second pivot arm and adapted for contacting an outside surface of the second limb at a point along the second limb adjacent the distal end of the second limb;

the first and second limb supports being operatively attached to the first and second pivot arms respectively for infinitely adjustable movement along the first or second pivot arm respectively, within a range of adjustment of the first and second limb supports, to thereby allow the first and second limb supports to be positioned respectively adjacent the distal ends of the first and second limbs of the bow.

25. The bow press of claim 24, further comprising an actuation apparatus, operatively connecting the first and second pivot arms for selectively pivoting the first and second pivot arms about their respective first and second pivot axes, in a manner providing symmetrical movement of the distal ends of the first and second pivot arms with respect to the second axis, in a direction away from or toward the first surface of the base.

26. A bow press, for deflecting the limbs of an archery bow to allow installation, replacement, or adjustment of a bow string or components of the bow, where the bow includes a bow handle and two limbs extending in opposite directions from the bow handle, with each limb including provisions at a distal end thereof for attaching the string, the bow press comprising:

a base defining a longitudinal axis of the base, and a second axis extending through the base orthogonally through the longitudinal axis, the longitudinal axis of the base and the second axis defining a plane including both the longitudinal axis of the base and the second axis;

a pivot arm for applying a bending force against one of the limbs of the bow;

a pivot arm bracket operatively connecting the pivot arm to the base and defining a pivot axis; and an inside surface surface support adapted for contacting an inside surface of the bow at a first point along the bow;

the pivot arm having a pivoted end and a distal end thereof, the pivoted end being pivotably attached to the pivot arm bracket for pivoting motion of the pivot arm about a pivot axis in a manner that constrains the distal end the pivot arm to circumscribe an arc extending generally parallel to the plane including the longitudinal axis of the base;

the inside surface support being attached to the pivot arm bracket at a point inboard of the first pivot axis, with respect to the second axis, and extending generally transversely outward from the pivot arm bracket with respect to the plane containing both the first longitudinal axis and the second axis;

the spacing between the inside surface support and the pivot axis being fixed at a predetermined distance.

27. The bow press of claim 26, wherein the inside surface support is disposed in close proximity to the pivot point at a location that is farther away from the longitudinal axis than the pivot point.

28. A bow press comprising:

a base;

first and second brackets slidable along the base in a spaced relation, the first bracket being movable relative to the second bracket;

first and second pivot arms having ends that are pivotably connected to the first and second brackets;

first and second supports on the first and second brackets, respectively; and the first and second supports being spaced a fixed distance from the first and second pivot joints, respectively.

29. The bow press of claim 28, wherein relative movement between the brackets toward and away from each other along the base does not adjust the fixed distance between the first and second supports and the first and second pivot joints, respectively.

* * * * *

Dedication

6,968,834—Steve Gibbs, Holton, IN. BOW PRESS. Patent dated Nov. 29, 2005. Disclaimer filed Feb. 22, 2006, by the assignee, C. S. Gibbs Corporation.

Hereby dedicates to the Public, the entire term of said patent.

*(Official Gazette, May 9, 2006)*